US006862775B2

(12) United States Patent
Albert et al.

(10) Patent No.: US 6,862,775 B2
(45) Date of Patent: Mar. 8, 2005

(54) VACUUM CLEANER NOZZLE

(75) Inventors: Wilma Albert, Wülfershausen (DE); Martin Jessenberger, Eussenhausen (DE); Herbert Kess, Bad Neustadt (DE); Andreas Schlereth, Bad Neustadt (DE); Thomas Seith, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 149 days.

(21) Appl. No.: 10/223,285

(22) Filed: Aug. 19, 2002

(65) Prior Publication Data

US 2003/0028996 A1 Feb. 13, 2003

Related U.S. Application Data

(63) Continuation of application No. PCT/EP01/01383, filed on Feb. 8, 2001.

(30) Foreign Application Priority Data

Feb. 17, 2000 (DE) ..... 100 07 170

(51) Int. Cl.[7] ..... A47L 9/06
(52) U.S. Cl. ..... 15/373; 15/398; 15/415.1
(58) Field of Search ..... 15/368, 373, 393, 15/398, 401, 415.1

(56) References Cited

U.S. PATENT DOCUMENTS

| | | | | | |
|---|---|---|---|---|---|
| 2,093,741 | A | * | 9/1937 | Smith | 15/415.1 |
| 2,249,463 | A | * | 7/1941 | Dunbar | 15/368 |
| 2,333,471 | A | * | 11/1943 | Cranmer | 15/401 |
| 2,335,448 | A | * | 11/1943 | Ross | 15/373 |
| 2,500,977 | A | | 3/1950 | Beede | |
| 2,510,270 | A | | 6/1950 | Yonkers | |
| D161,681 | S | * | 1/1951 | Dreyfuss | D32/33 |
| 2,880,446 | A | * | 4/1959 | Muller | 15/373 |
| 5,564,161 | A | * | 10/1996 | Glatz | 15/415.1 |
| 6,009,594 | A | * | 1/2000 | Grey | 15/322 |

FOREIGN PATENT DOCUMENTS

| | | |
|---|---|---|
| CH | 249346 | 4/1948 |
| DE | 682 087 | 10/1939 |
| DE | 682 886 | 10/1939 |
| DE | G 94 08 560.9 U1 | 10/1994 |
| GB | 494826 | 11/1938 |

* cited by examiner

*Primary Examiner*—Terrence R. Till
(74) *Attorney, Agent, or Firm*—Laurence A. Greenberg; Werner H. Stemer; Gregory L. Mayback

(57) ABSTRACT

A vacuum cleaner nozzle having a housing at which a pivoting terminal connecting piece is attached for connecting a guide suction pipe. A spoiler-shaped surface on at least one side of the nozzle housing, which protrudes over the contour of the nozzle housing and tapers to a point at its free end, eliminates the need to separately lift a loose rug to be able to clean at least the border region covered by the rug.

17 Claims, 3 Drawing Sheets

VACUUM CLEANER NOZZLE

CROSS-REFERENCE TO RELATED APPLICATION

This application is a continuation of copending International Application No. PCT/EP01/01383, filed Feb. 8, 2001, which designated the United States and was not published in English.

BACKGROUND OF THE INVENTION

Field of the Invention

The present invention relates to a vacuum cleaner nozzle or mouthpiece at whose housing a swiveling terminal connecting piece is provided for attaching a guide suction pipe.

A vacuum cleaner nozzle is disclosed in German Utility Model DE 94 08 560. In this prior art vacuum cleaner nozzle, the wall portions of the nozzle housing extend approximately vertically both on the front and back sides and on the two short sides. As a result, there is a wall face having a certain width in the vertical direction with which the nozzle housing can hit obstacles that lie in the suction path during vacuuming. This is also true when there are loose rugs on a surface that is being vacuumed. Then, the vacuum cleaner nozzle hits the border edge of such loose rugs with one of the side edges of its housing during vacuuming, depending on the direction of movement.

With loose rugs, dirt can collect under the rug in its border region. To be able to vacuum such dirt also during vacuuming, the rug must be lifted or folded back by hand so that dirt that has collected in the border region can be reached with the vacuum cleaner nozzle and vacuumed up.

SUMMARY OF THE INVENTION

It is accordingly an object of the invention to provide a vacuum cleaner nozzle that overcomes the hereinaforementioned disadvantages of the heretofore-known devices of this general type and that eliminates the need to separately lift a loose rug to clean at least the border regions covered by the rug.

With the foregoing and other objects in view, there is provided, in accordance with the invention, a vacuum cleaner nozzle, including a housing having at least one side, a contour, a terminal connecting piece adapted to connect to a suction pipe, and an element having a free end, the element disposed on the at least one side, protruding beyond the contour, and tapering to an approximate point at the free end.

The object is inventively achieved by providing, on at least one side of the nozzle housing, an element that protrudes beyond the contour of the nozzle housing and that tapers to a point at its free end. With such an element, it is possible to move beneath the rug at its border edge and lift it, accordingly, so that dirt beneath the rug can be vacuumed at least in the border region of the rug.

In accordance with another feature of the invention, it is particularly advantageous when the element is constructed as a surface in the form of a spoiler. As such, it is possible to move the spoiler-shaped surface under a loose rug evenly in a correspondingly large region and to vacuum beneath the rug there.

When the element (the spoiler-shaped surface) is provided at the front side of the nozzle housing and extends in the plane of the bearing surface of the vacuum cleaner nozzle, it is easy to move under a loose rug during the forward motion of the vacuum cleaner nozzle.

A strong lifting of the rug can be achieved when the element (the spoiler-shaped area) is so constructed on the front side of the nozzle housing that it is bent approximately 90° from the bearing surface of the vacuum cleaner nozzle in the upward direction.

When the element (the spoiler-shaped area) is provided on the back side of the vacuum cleaner nozzle, the peripheral suction at the front side of the vacuum cleaner nozzle is not impaired, and, furthermore, the vacuum cleaner nozzle can be pulled along the edge of a rug with its back side to vacuum beneath the rug.

Such advantages are also present when the element (the spoiler-shaped surface) is provided on at least one short side of the nozzle housing.

The fabrication and assembly costs can be minimized when the element (the spoiler-shaped surface) is formed at the nozzle housing in one piece.

In accordance with a further feature of the invention, the element is spur-shaped, triangular, and/or has a triangular point.

The element can also be utilized with advantage when a brush carrier that can be swiveled between working and idle positions is provided at the nozzle housing. In such a case, if the element is not connected directly to the nozzle housing, which is of course also possible, it is fastened to the brush carrier and can be swiveled together therewith.

In alternative embodiments, the element is connected to the nozzle housing by a pivot axle or lock strip and can be pivoted relative to the nozzle housing or locked in different height positions in the lock strip.

With the objects of the invention in view, in a vacuum cleaner having a vacuum fluidically connected to a vacuum hose, there is also provided a vacuum cleaner nozzle including a housing having at least one side, a contour, a terminal connecting piece adapted to connect to a suction pipe, and an element having a free end, the element disposed on the at least one side, protruding beyond the contour, and tapering to an approximate point at the free end.

With the objects of the invention in view, there is also provided a vacuum cleaner including a vacuum, a vacuum hose, and a vacuum cleaner nozzle fluidically connected to the vacuum through the vacuum hose, the nozzle having at least one side, a contour, a terminal connecting piece adapted to connect to a suction pipe, and an element having a free end, the element disposed on the at least one side, protruding beyond the contour, and tapering to an approximate point at the free end.

Such a configuration produces a height-adjustable rug lifter that makes working easy on the user's back. It is no longer necessary to lift loose rugs by hand to clean the surfaces beneath them, at least in the region directly adjacent the rug borders.

Other features that are considered as characteristic for the invention are set forth in the appended claims.

Although the invention is illustrated and described herein as embodied in a vacuum cleaner nozzle, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
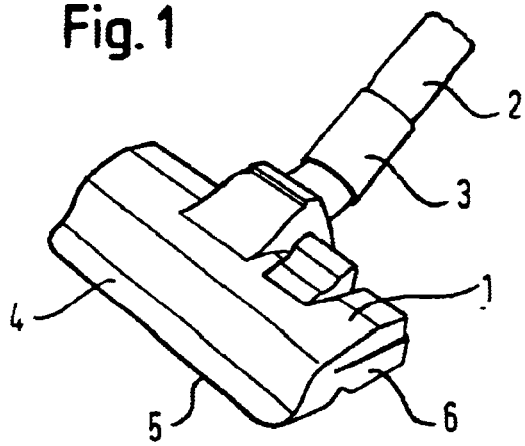
FIG. 1 is a fragmentary, perspective view of a vacuum cleaner nozzle with a spoiler-shaped surface formed on a front side thereof and extends in a plane of the bearing surface of the vacuum cleaner nozzle according to the invention.

Referring now to the figures of the drawings in detail and first, particularly to FIG. 1 thereof, there is shown a housing 1 of a vacuum cleaner nozzle at which a pivoting terminal connecting piece 3 is attached, which serves for the connection of a suction pipe 2. The suction pipe 2 that is attached to the terminal connecting piece 3 effects movement of the vacuum cleaner nozzle across the vacuuming surface in vacuuming operations.

In the vacuum cleaner nozzle represented in FIG. 1, a spoiler-shaped surface 4 is formed on the front side of the nozzle housing 1. The spoiler-shaped surface 4 protrudes over the actual contour of the nozzle housing 1 and tapers to a point at its free end 5. With the tapered end 5, it is possible to go beneath the border edges of a loose rug that lays on the vacuuming surface during a vacuuming operation so that at least the surface beneath the border area of the rug can be cleaned. The rug no longer must be lifted by hand to effect the lifting.

Figure 2:
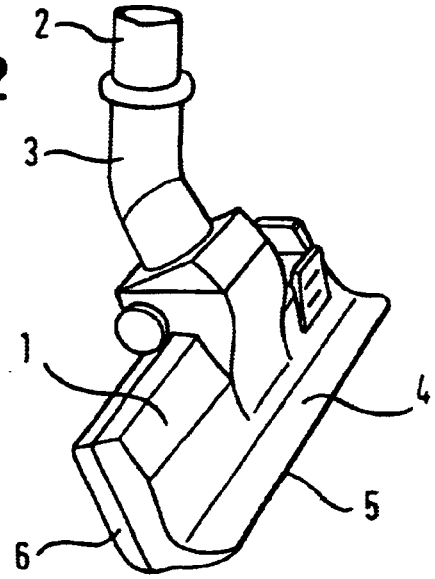
FIG. 2 is a fragmentary, perspective view of an alternative embodiment of the spoiler-shaped surface of FIG. 1 bent upward on the front side of the nozzle housing.

If the spoiler-shaped surface 4 at the nozzle housing 1 is bent in the upward direction as represented in FIG. 2, then the nozzle housing 1 folds down 90° out of its normal working position when the suction pipe 2 is raised. Then, the spoiler-shaped surface 4 achieves a position approximately parallel to the vacuuming surface. The free end 5 can then be moved under a loose rug. If the suction pipe 2 is then lowered, then the vacuum cleaner nozzle assumes its normal position again, whereby the free end 5 of the spoiler-shaped surface 4 that is under the rug swings up, thus, lifting the rug. The vacuum cleaner nozzle can now be moved back and forth beneath the rug for vacuuming purposes.

Figure 3:
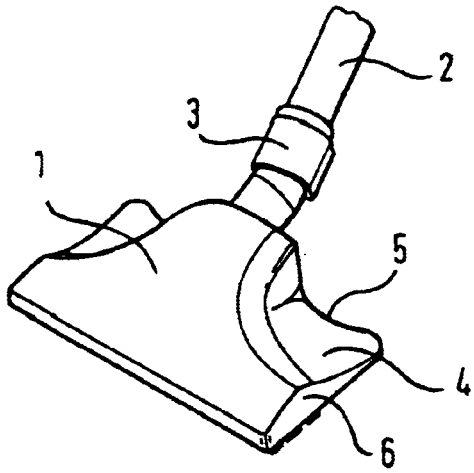
FIG. 3 is a fragmentary, perspective view of another embodiment of the spoiler-shaped surface of FIG. 1 formed on a back side of the nozzle housing.

The embodiment of a vacuum cleaner nozzle represented in FIG. 3 makes it possible to move under a loose rug by pulling the vacuum cleaner nozzle 1 backward. The nozzle 1 can be pulled along a border edge of a loose rug. The vacuum cleaner nozzle 1 then reaches under the border region of the rug and sucks up the dirt that has collected under the rug there. With such a construction of the vacuum cleaner nozzle 1, the peripheral suction characteristics of the vacuum cleaner nozzle on its front side are not adversely affected.

This is also true when a spoiler-shaped surface 4 is provided on one or both short sides 6 of the vacuum cleaner nozzle. Here, as well, the vacuum cleaner nozzle can be pulled along a border edge of the rug, and the dirt that has collected there can be vacuumed up.

Instead of a spoiler-shaped surface, a spur-shaped element or an element in the shape of a triangular point can be provided at the nozzle housing. A loose rug can also be lifted as required by such an element.

Figure 4:
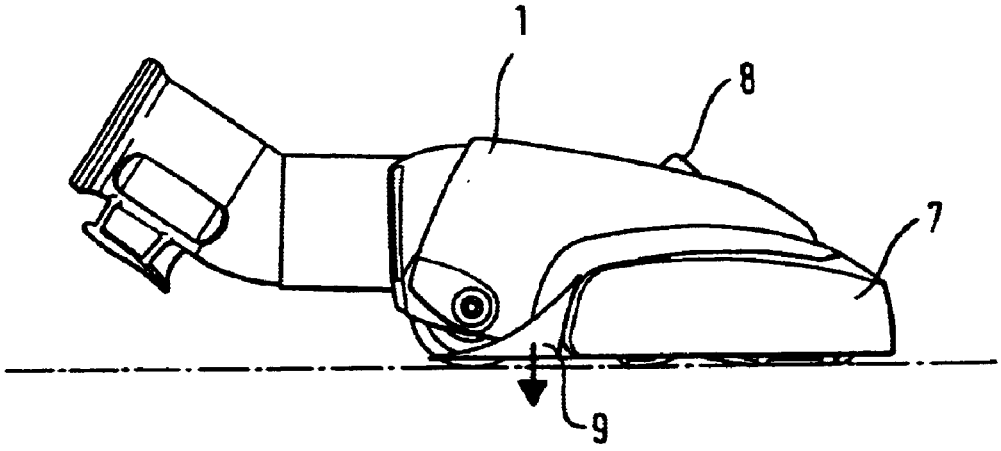
FIG. 4 is a fragmentary, perspective view of a vacuum cleaner nozzle according to the invention with a brush carrier in a raised position.
Figure 5:
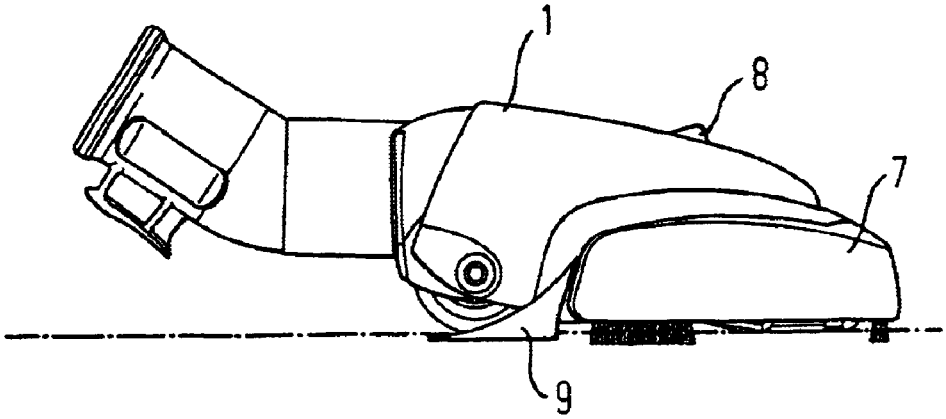
FIG. 5 is a fragmentary, perspective view of the nozzle of FIG. 4 with the brush carrier in a lowered position.

In another exemplifying embodiment (FIGS. 4 and 5) a height-adjustable brush carrier 7 is provided inside the housing 1 of the vacuum cleaner nozzle, whose height is adjusted relative to the housing 1 by a footswitch 8 or other actuating knob. The element 9 serving as the rug lifter is attached to the brush carrier 7. The element 9 is, thus, moved together with the brush carrier 8 as illustrated from FIG. 4 to FIG. 5.

Alternatively, the element 9 for lifting the rug can also be fastened to the housing 1 even if a movable brush carrier is provided.

Figure 6:
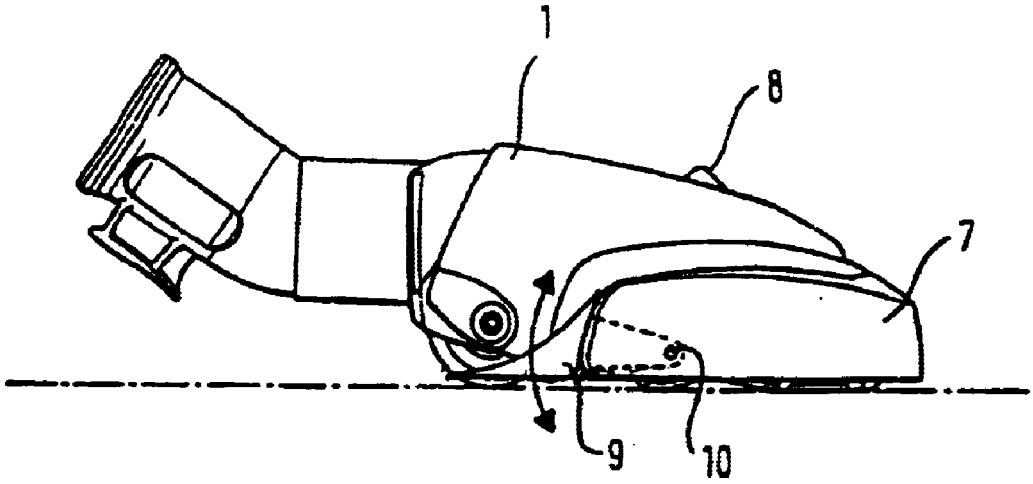
FIG. 6 is a fragmentary, perspective view of another embodiment of the spoiler-shaped surface of FIG. 1 formed on a back side of the nozzle housing.
Figure 7:
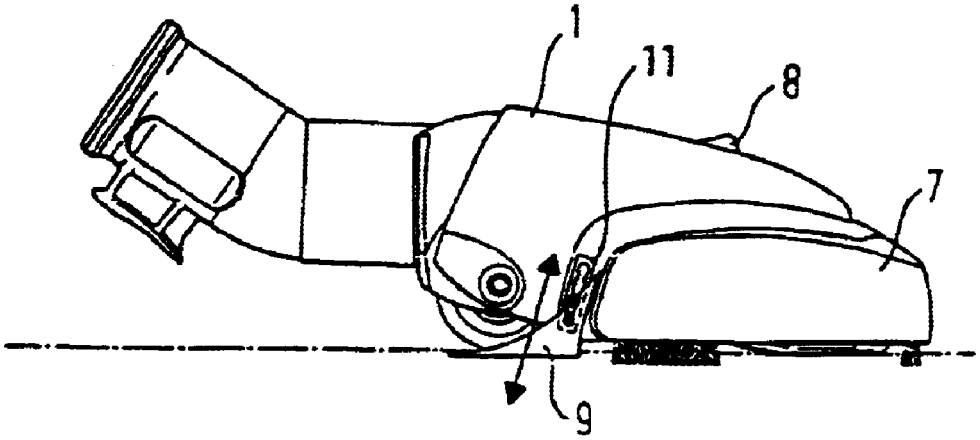
FIG. 7 is a fragmentary, perspective view another embodiment of the nozzle of FIG. 5 with the brush carrier in a lowered position.

In another embodiment, which can likewise be illustrated with FIGS. 6 and 7, the height of the element 9 can be separately adjustable, regardless of whether or not a brush carrier 8 is provided. Such a configuration is accomplished, for example, with the aid of a pivot axle 10 by which the element 9 can be swung relative to the housing 1, or with the aid of a lock strip 11 that is connected to the nozzle housing, in which the element 9 can be locked in different positions.

Therefore, the invention eliminates the need to lift a rug by hand to vacuum the dirt under a loose rug at least in its border area. The underneath area is reached by the vacuum cleaner nozzle, and the dirt there is vacuumed up, simply with movement along the respective border edge of the rug.

We claim:

1. A vacuum cleaner nozzle, comprising:

a housing having:

a suction side;

at least one other side;

a contour having edges defining a plane on said suction side of said housing;

a terminal connecting piece adapted to connect to a suction pipe; and an element having a free end, said element disposed on said at least one other side, protruding beyond said contour, and tapering to an approximate point at said free end, said approximate point at said free end positioned at or below said plane defined by said contour.

2. The vacuum cleaner nozzle according to claim 1, wherein said element is spoiler-shaped.

3. The vacuum cleaner nozzle according to claim 1, wherein said element is a spoiler-shaped surface.

4. The vacuum cleaner nozzle according to claim 1, wherein:

said housing has a front side; and said element is provided on said front side.

5. The vacuum cleaner nozzle according to claim 1, wherein:

said housing has a rear side; and said element is disposed on said rear side.

6. The vacuum cleaner nozzle according to claim 1, wherein:

said housing has at least one short side; and said element is disposed on said at least one short side.

7. The vacuum cleaner nozzle according to claim 1, wherein said element is integral with said housing.

8. The vacuum cleaner nozzle according to claim 1, wherein said element and said housing are in one piece.

9. The vacuum cleaner nozzle according to claim 1, wherein said element is spur-shaped.

10. The vacuum cleaner nozzle according to claim 1, wherein said element is triangular.

11. The vacuum cleaner nozzle according to claim 1, wherein said element is a triangular point.

12. A vacuum cleaner nozzle, comprising:

a housing having:
at least one side;
a contour;
a terminal connecting piece adapted to connect to a suction pipe; and
an element having a free end, said element disposed on said at least one side, protruding beyond said contour, and tapering to an approximate point at said free end; and a moveable brush carrier mounted on said housing, said brush carrier moveable between a working position and an idle position, said element fastened on said brush carrier and moveable with said brush carrier.

13. A vacuum cleaner nozzle, comprising:

a housing having:
at least one side;
a contour;
a terminal connecting piece adapted to connect to a suction pipe; and
an element having a free end, said element disposed on said at least one side protruding beyond said contour, and tapering to an approximate point at said free end; and a pivotable brush carrier mounted on said housing, said brush carrier pivoting between a working position and an idle position, said element fastened on said brush carrier and pivoting with said brush carrier.

14. A vacuum cleaner nozzle comprising:

a housing having:
at least one side;
a contour;
a terminal connecting piece adapted to connect to a auction pipe;
an element having a free end, said element disposed on said at least one side, protruding beyond said contour, and tapering to an approximate point at said free end;
a pivot axle; and
said pivot axle moveably connecting said element to said housing for moving said element relative to said housing.

15. A vacuum cleaner nozzle, comprising:

a housing having:
at least one side;
a contour;
a terminal connecting piece adapted to connect to a suction pipe;
an element having a free end, said element disposed on said at least one side, protruding beyond said contour, and tapering to an approximate point at said free end;
a lock strip; and
said lock strip moveably connecting said element to said housing and locking said element in various positions relative to said housing.

16. In a vacuum cleaner having a vacuum fluidically connected to a vacuum hose, a vacuum cleaner nozzle, comprising:

a housing having:
a suction side;
at least one other side;
a contour having edges defining a plane on said suction side of said housing;
a terminal connecting piece adapted to connect to a suction pipe; and
an element having a free end, said element disposed on said at least one other side, protruding beyond said contour, and tapering to an approximate point at said free end, said approximate point at said free end positioned at or below said plane defined by said contour.

17. A vacuum cleaner, comprising:

a vacuum;

a vacuum hose; and a vacuum cleaner nozzle fluidically connected to said vacuum through said vacuum hose, said nozzle having:
a suction side;
at least one other side;
a contour having edges defining a plane on said suction side of said housing;
a terminal connecting piece adapted to connect to a suction pipe; and
an element having a free end, said element disposed on said at least one other side, protruding beyond said contour, and tapering to an approximate point at said free end, said approximate point at said free end positioned at or below said plane defined by said contour.

* * * * *